US005562845A

United States Patent [19]

Miller et al.

[11] Patent Number: 5,562,845

[45] Date of Patent: Oct. 8, 1996

[54] CONCRETE FORM AND SELF-CONTAINED WALER CLAMP ASSEMBLY

[75] Inventors: Michael J. Miller, Medinah; Manuel Lopez, Arlington Heights, both of Ill.

[73] Assignee: Symons Corporation, Des Plaines, Ill.

[21] Appl. No.: 313,420

[22] Filed: Sep. 27, 1994

[51] Int. Cl.[6] ..... E04G 11/06; E04G 17/00

[52] U.S. Cl. ..... 249/45; 249/196; 249/219.2; 249/192; 249/219.1

[58] Field of Search ..... 249/219.2, 219.1, 249/192, 195, 45, 196

[56] References Cited

U.S. PATENT DOCUMENTS

| | | | |
|---|---|---|---|
| 3,584,827 | 6/1971 | Shoemaker | 249/219.2 |
| 3,584,829 | 6/1971 | Shoemaker | 249/219.2 |
| 3,655,162 | 4/1972 | Shoemaker | 249/219.2 |
| 3,724,806 | 4/1973 | Shoemaker | 249/219.2 |
| 3,945,602 | 3/1976 | Doubleday et al. | 249/219.2 |
| 5,039,059 | 8/1991 | Miller | 249/196 |

*Primary Examiner*—Robert Warden

*Assistant Examiner*—Hien Tran

*Attorney, Agent, or Firm*—Marshall, O'Toole, Gerstein, Murray & Borun

[57] ABSTRACT

In order to provide self-containment in a waler clamp assembly with adjustment capabilities, the assembly includes a generally U-shaped bracket having a pair of generally parallel spaced legs joined at one end by a connecting bight portion with one of the legs having a distal end with a latching key adapted to fit into a hole in a form support. Specifically, the latching key is adapted to fit into the hole in a first orientation of the bracket relative to a concrete form and is also adapted to be securely locked within the form support in a second orientation of the bracket relative to the concrete form, and the bracket also has generally aligned openings in the legs near and generally parallel to the bight portion at a point opposite the latching key. With this arrangement, the tapered wedge projects through the generally aligned openings in the bracket, is movable generally perpendicular to the legs of the bracket to be driven in wedge fashion to force a waler board carried by the bracket against the concrete form, and is retained in integrally associated relation with the bracket.

15 Claims, 3 Drawing Sheets

CONCRETE FORM AND SELF-CONTAINED WALER CLAMP ASSEMBLY

FIELD OF THE INVENTION

The present invention is generally related to the field of concrete forming systems and, still more particularly, a self-contained waler clamp assembly for a form having a plurality of spaced formed supports.

BACKGROUND OF THE INVENTION

Currently, it is well known that there are a large number of different waler clamp assemblies that are in use. They perform the function for which they are intended to varying degrees of effectiveness, although they often have multiple components that are not integrally related and, thus, can become misplaced or lost. Clearly, this is undesirable since it requires that such lost components be replaced, adding a burden in terms of cost.

As will be appreciated, the cost involves more than the replacement of the lost or misplaced component. It also involves a labor cost that results from searching for misplaced components in the field and replacing them when they are lost. Also, the complexity of many of the typical waler clamp assemblies increases the cost of labor.

In this connection, the waler clamp assemblies are known to require varying degrees of skill in terms of the necessary assembly operations. It is not uncommon for it to require two workmen to manipulate the waler clamp assemblies while guiding the walers into position. Unquestionably, it would be desirable to have a self-contained waler clamp assembly for convenient manual application, particularly to aluminum form siderails.

Still more specifically, it is recognized that it would be highly desirable to have a means of adjustment in the aluminum form industry to accommodate for tolerance variations in waler lumber size.

The present invention is directed to overcoming one or more of the foregoing problems and achieving one or more of the resulting objects.

SUMMARY OF THE INVENTION

It is a principal object of the present invention to provide a unique and improved self-contained waler clamp assembly. It is a further object of the present invention to provide such a waler clamp assembly particularly well suited for a concrete form of the type having a plurality of spaced form supports. It is an additional object of the present invention to provide a waler clamp assembly for aluminum forms having an adjustment capability.

Accordingly, the present invention is directed to a self-contained waler clamp assembly for a concrete form having a plurality of spaced form supports, and the assembly includes a generally U-shaped bracket having a pair of generally parallel spaced legs joined at one end by a connecting bight portion, with one of the legs having a distal end with a latching key. The latching key is adapted to fit into a hole in one of the form supports in a first orientation of the bracket relative to the concrete form and is also adapted to be securely locked within the hole in the form support in a second orientation of the bracket relative to the concrete form, and the bracket also has generally aligned openings in the legs near and generally parallel to the bight portion at a point opposite the latching key. With this arrangement, a tapered wedge projects through the generally aligned openings in the legs and is retained in integrally associated relation with the bracket in such manner as to be movable generally perpendicular to the legs of the bracket to be driven in wedge fashion to force a waler board carried by the bracket against the concrete form.

In an exemplary embodiment of the invention, the latching key comprises a flat finger which is generally coplanar with and extends generally perpendicular to the one of the legs with which it is integrally formed at the distal end thereof. It is also advantageous or the latching key to have a tooth which is located generally intermediate opposing ends of the flat finger and projects so as to extend generally parallel to the one of the legs with which the latching key is integrally formed in a direction generally facing the bight portion of the bracket. Still additionally, there are preferably adjacent form supports having aligned round holes and formed to define a tooth-receiving space at least in the area of the holes to receive the tooth on the latching key.

In one embodiment, the generally aligned openings in the legs of the bracket include at least one which is generally U-shaped, having a waler-facing portion generally parallel to the bight portion of the bracket and a pair of leg-receiving portions generally perpendicular to the waler-facing portion in a direction extending generally towards the bight portion of the bracket. The tapered wedge is then advantageously generally U-shaped, having a flat waler-engaging surface disposed in the waler-facing portion of the generally U-shaped opening and having a pair of tapered legs which are integral with and generally perpendicular to the flat waler-engaging surface disposed in the leg-receiving portions of the generally U-shaped opening for limited movement relative to the legs of the bracket. In another embodiment, the generally aligned openings include a pair of wedge-receiving slots extending in a direction generally parallel to the legs of the bracket, and the tapered wedge comprises a flat generally V-shaped wedge, having a waler-engaging surface and a pair of flat generally parallel surfaces to conform to the slots for limited movement relative to the legs of the bracket.

In a highly preferred embodiment, it is the upper one of the legs of the bracket which is formed so as to have its distal end fashioned in the shape of the latching key which is adapted to fit into the hole. Advantageously, the holes are formed in each one of a plurality of spaced form supports which are disposed in a generally vertical orientation, and the latching key is adapted to fit into any one of the holes with the bracket thereby being adapted to be securely locked within an adjacent pair of form supports in a generally horizontal orientation when the bracket is generally perpendicular to the concrete wall form. With this arrangement, the latching key comprises a flat finger generally coplanar with and extending perpendicular to the upper one of the legs with the tooth extending generally parallel thereto.

As for additional details, the tapered wedge preferably includes an enlargement on a narrow end thereof for retaining the wedge integral with the bracket. This serves as a very effective means for retaining the tapered wedge in integrally related operative association with the bracket. As a result, the waler clamp assembly which will be understood as including the bracket and the wedge is quite accurately defined as a self-contained assembly.

In a highly preferred embodiment, the upper one of the legs is longer than a lower one of the legs, with the latching key being positioned at a point so as to extend beyond the distal end of the lower one of the legs. Still additionally, the lower one of the legs preferably has an integral bearing flange to engage the vertical frame supports when the latching key is securely locked within the holes in a generally horizontal orientation.

In a most highly preferred embodiment, the present invention comprises a self-contained two-part waler clamp assembly for an aluminum concrete wall form defined by a plurality of aluminum wall form panels. Each of the wall form panels advantageously has extruded aluminum vertical siderails for joining the wall form panels in upstanding edge-to-edge relationship. In this manner, the wall form panels are well suited for a concrete pour using the aluminum concrete wall form and self-contained two-part waler clamp assembly of the present invention.

Other objects, advantages and features of the present invention will become apparent from a consideration of the following specification taken in conjunction with the accompanying drawings.

DETAILED DESCRIPTION OF THE PREFERRED EMBODIMENTS

Figure 1:
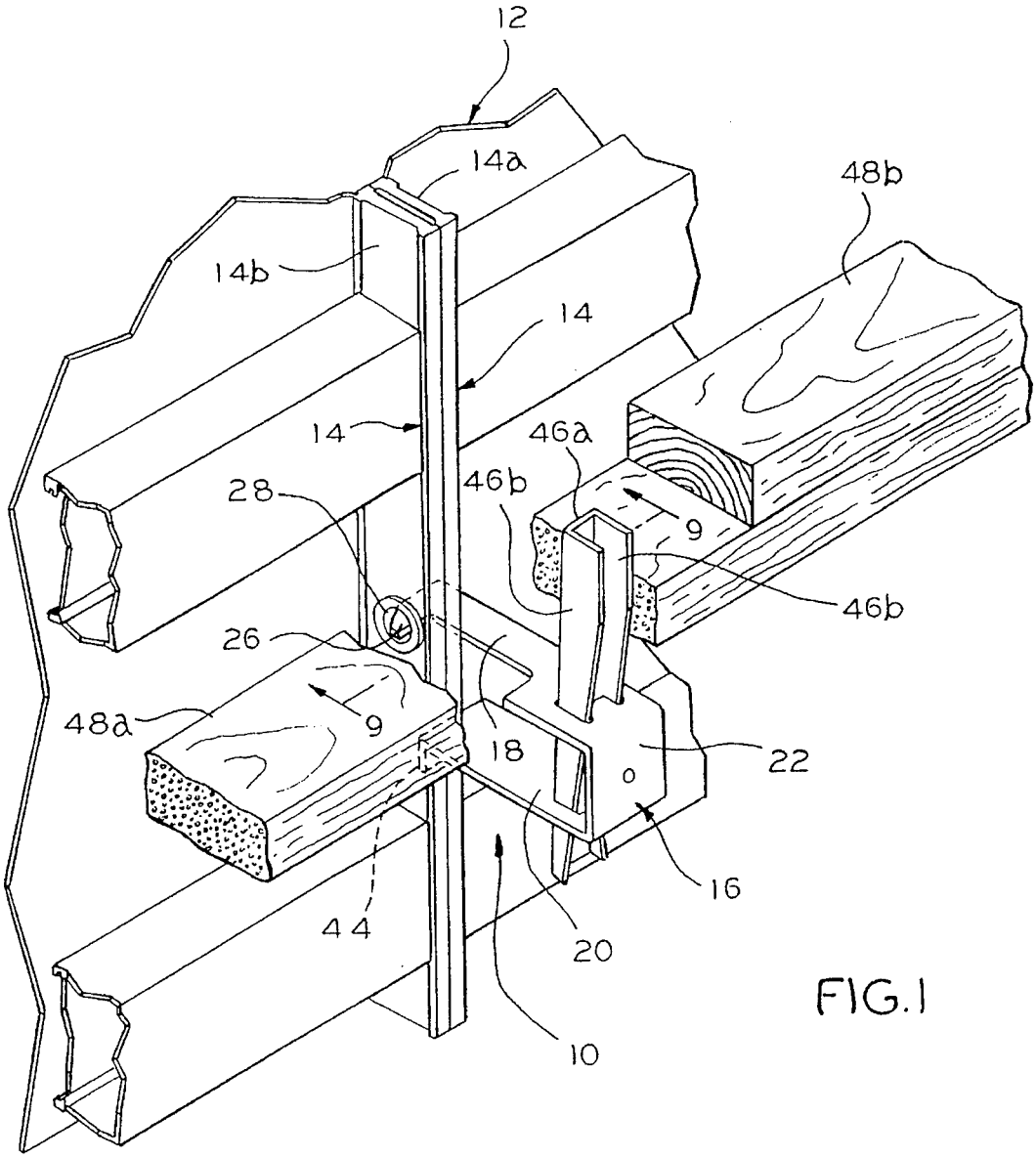
FIG. 1 is a fragmentary perspective view of a limited portion of a concrete wall form showing a self-contained waler clamp assembly in accordance with the present invention.

In the illustrations given, and with reference first to FIG. 1, the reference numeral 10 designates generally a self-contained waler clamp assembly for a concrete form 12 having a plurality of spaced form supports which have been generally designated as 14. Typically, the self-contained waler clamp assembly 10 is adapted for use where the concrete form 12 is a wall form in which case the spaced form supports such as 14 will advantageously comprise vertical form supports where a pair of such supports will typically be placed in adjacent relation. In a highly preferred application, the self-contained waler clamp assembly 10 is used for an aluminum concrete wall form 12 defined by a plurality of aluminum wall form panels 12*a*, each having an extruded aluminum vertical siderail such as 14 at each of opposite edges for joining the panels 12*a* in an upstanding edge-to-edge relationship. As described in detail hereinafter, the self-contained waler clamp assembly 10 comprises a two-part assembly for an aluminum concrete wall form 12 to facilitate a concrete pour in a manner providing unique adjustment capabilities.

Figure 3:
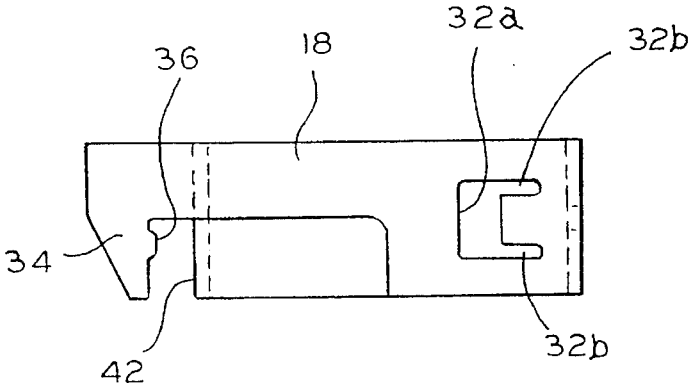
FIG. 3 is a top plan view which more fully illustrates details of the self-contained waler clamp assembly in FIG. 1 with the tapered wedge removed therefrom.
Figure 2:
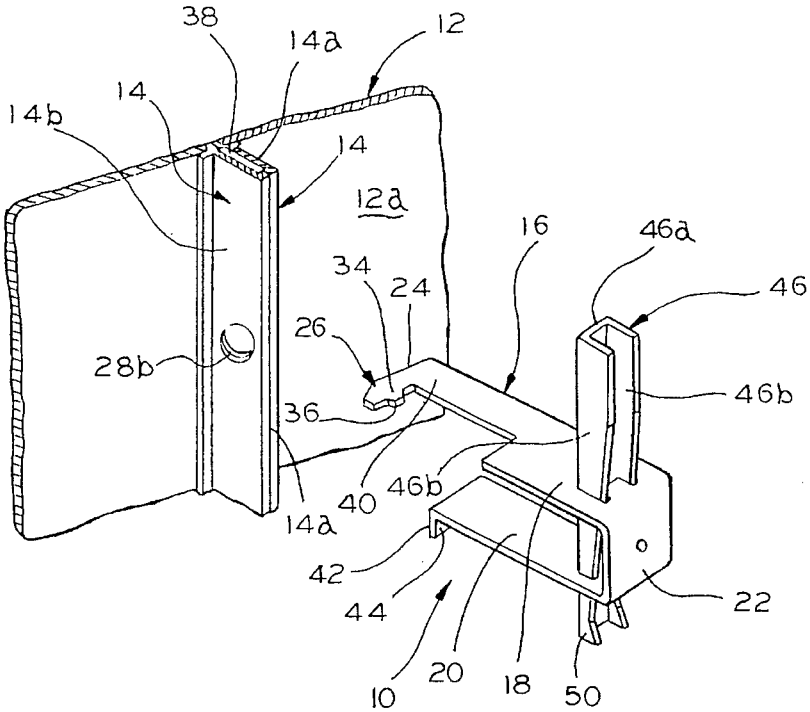
FIG. 2 is a perspective view schematically illustrating the self-contained waler clamp assembly in FIG. 1 separated from the concrete wall form before it is manually applied to a form support.

Referring now to FIGS. 1–3, the waler clamp assembly 10 includes a generally U-shaped bracket 16 having a pair of generally parallel spaced legs 18 and 20 joined at one end by a connecting bight portion 22. An upper one of the legs 18 has a distal end generally at 24 formed as a latching key generally designated 26 which is adapted to fit into and extend through round holes 28 in adjacent ones of the vertical siderails 14 in a first, very generally horizontal orientation with the bracket at a large acute angle to the concrete wall form 12, and the latching key 26 is also adapted to be securely locked within the holes 28 in a second, horizontal orientation (see FIG. 1) with the bracket 16 disposed so as to be generally perpendicular to the concrete wall form 12. By now comparing FIGS. 3, 4*a*, and 5*a*, the bracket 16 will further be seen to have generally aligned openings 30 and 32 in the legs 18 and 20 near and generally parallel to the bight portion 22 opposite the latching key 26.

As best shown in FIGS. 2 and 3, the latching key 26 comprises a flat finger 34 generally coplanar with and extending generally perpendicular to the upper one of the legs 18. The latching key 26 also has a tooth 36 generally intermediate opposing ends of the flat finger 34. With regard to the tooth 36, it extends generally parallel to the upper one of the legs 18 in a direction generally facing the bight portion 22 of the bracket 16.

Figure 9:
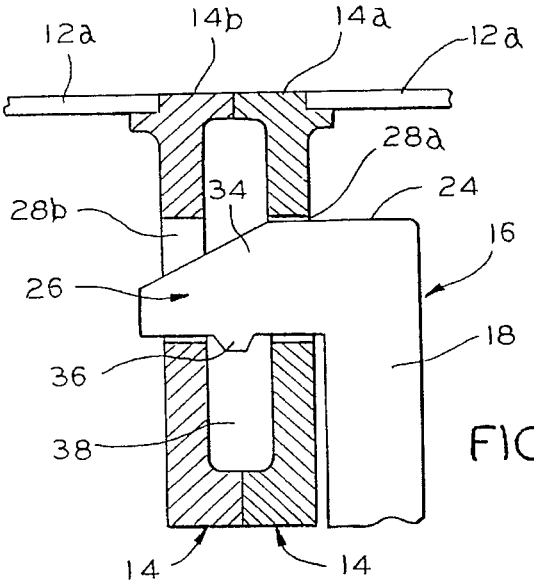
FIG. 9 is a partial cross-sectional view taken generally along the line 9—9 of FIG. 1.

Referring specifically to FIG. 9, the adjacent form supports 14 will be seen to include corresponding aligned holes 28 for allowing the flat finger 34 and tooth 36 of the latching key 26 to be passed through a first one of the holes 28*a* in one of the adjacent form supports 14*a* and to be retained in a space 38 formed between the adjacent form supports 14*a* and 14*b* as by extrusion or the like with the tip of the flat finger 34 extending through a second one of the holes 28*b* in the other of the adjacent form supports 14*b*.

Figure 4A:
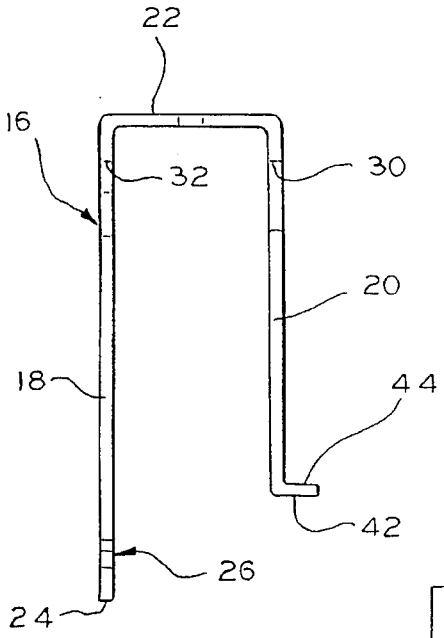
FIG. 4*a* is a side elevational view which also more fully illustrates details of the self-contained waler clamp assembly in FIG. 1 with the tapered wedge removed therefrom.

As for other details of the present invention, the upper one of the legs 18 is suitably formed so as to be longer than the lower one of the legs 20 in order for the latching key 26 to be positioned at a point beyond the distal end 42 of the lower one of the legs 20 (see FIGS. 1, 3, and 4*a*). As also shown in FIGS. 1, 2, and 4*a*, the lower one of the legs 20 has an integral bearing flange 44 adapted for engagement with outer edges 14*a* of adjacent vertical form supports or siderails 14 when the latching key 26 is securely locked within the holes 28 in the vertical form supports or siderails 14 in a horizontal orientation.

Figure 4B:
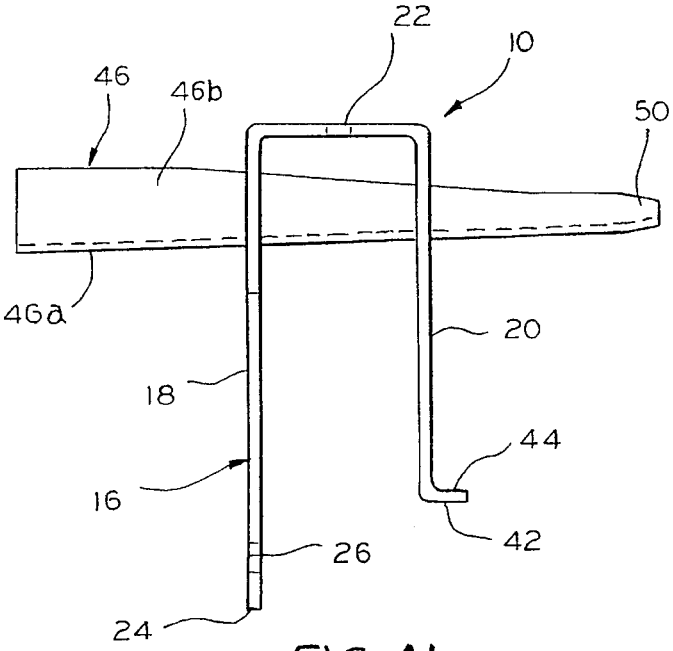
FIG. 4*b* is a side elevational view which further more fully illustrates details of the self-contained water clamp assembly in FIG. 1 with the tapered wedge in place therein.
Figure 5A:
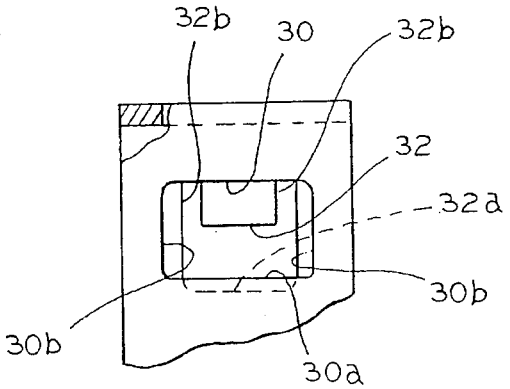
FIG. 5*a* is an enlarged fragmentary bottom plan view which also illustrates the self-contained waler clamp assembly in FIG. 1 with the tapered wedge removed therefrom.
Figure 5B:
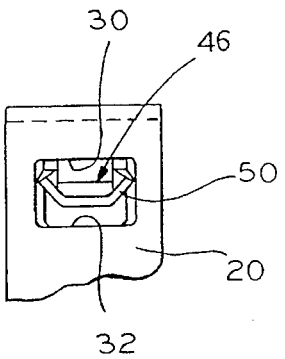
FIG. 5*b* is an enlarged fragmentary bottom plan view which further illustrates the self-contained waler clamp assembly in FIG. 1 with the tapered wedge in place therein.

Referring now to FIGS. 1, 4*b*, and 5*b*, the self-contained waler clamp assembly 10 will be seen to include a tapered wedge generally designated 46 which projects through the generally aligned openings 30 and 32 in the bracket 16. The tapered wedge 46 will be understood to be movable generally perpendicular to the legs 18 and 20 of the bracket 16 to be driven in wedge fashion to force a waler board or boards, such as 48*a* and 48*b*, carried by the bracket 16 against the concrete form 12. As perhaps best shown in FIG. 5*b*, the tapered wedge 46 most advantageously includes an enlargement 50 formed on a narrow end of the wedge 46 so as to ensure that the wedge 46 is always retained in integral relation with the bracket 16.

Referring now to FIGS. 3, 5*a*, and 5*b*, the one of the generally aligned openings 32 in the leg 20 is generally U-shaped, having a waler-facing portion 32*a* generally parallel to the bight portion 22 of the bracket 16 and a pair of leg-receiving portions 32*b* generally perpendicular to the waler-facing portion 32*a* of the generally U-shaped opening 32 in a direction extending generally towards the bight portion 22 of the bracket 16. It will also be seen that the other of the generally aligned openings 30 in the leg 18 is generally rectangular having a waler-facing edge 30*a* generally parallel to the bight portion 22 of the bracket 16 and a pair of leg-facing edges 30*b* generally perpendicular to the waler-facing edge 30*a* of the generally rectangular opening 30 in a direction extending generally towards the bight portion 22 of the bracket 16. With this arrangement, the tapered wedge 46 is also generally U-shaped having a flat waler-engaging surface 46*a* which is slidably received in the waler-facing portion 32*a* of the generally U-shaped opening 32 and having a pair of tapered legs 46*b* which are integral with and generally perpendicular to the flat waler-engaging surface 46*a* slidably received in the leg-receiving portions 32*b* of the generally U-shaped opening 32.

With the arrangement just described, the relative dimensions of the generally rectangular opening 30, the generally U-shaped opening 32, and the tapered wedge 46 will be within the ability of those of ordinary skill in the art. It is simply a matter of providing suitable dimensions to allow the tapered wedge 46 to act as a wedge once the bracket 16 has been mounted as described hereinabove, whereby the tapered wedge 46 may be driven generally vertically downwardly as viewed in FIG. 1 so as to provide an adjustment capability for tolerance variations in lumber waler size, i.e., with regard to the waler boards such as 48*a* and 48*b*.

As will also be appreciated, the enlargement 50 may simply comprise outwardly flared tips on the tapered legs 46*b* that are of sufficient size to impede removal of the tapered wedge 46, i.e., withdrawal through the generally U-shaped opening 32.

Figure 6:
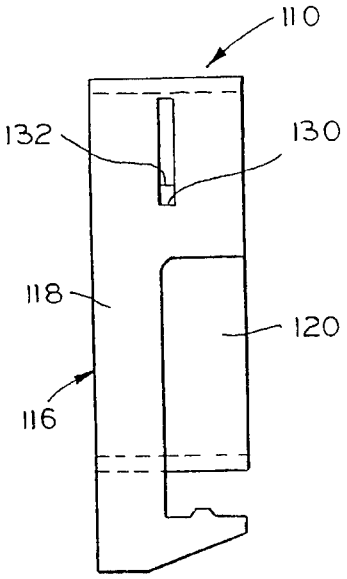
FIG. 6 is a top plan view of another embodiment of the self-contained waler clamp assembly of the present invention.
Figure 7:
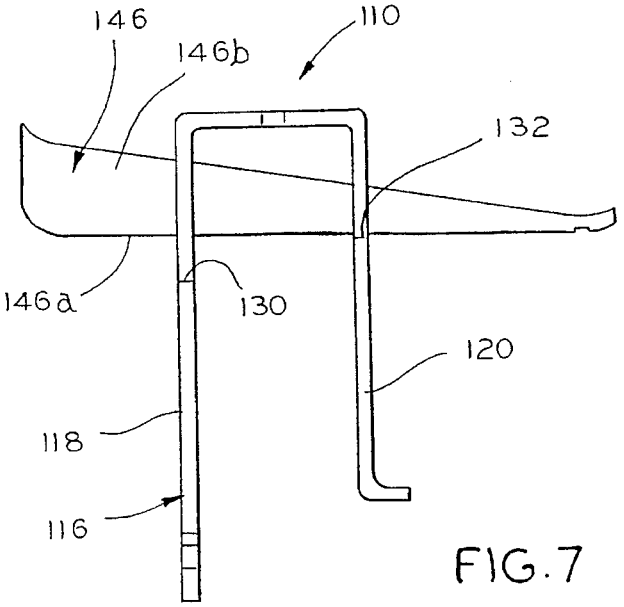
FIG. 7 is a side elevational view of the self-contained waler clamp assembly as also illustrated in FIG. 6.
Figure 8:
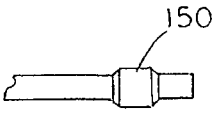
FIG. 8 is an enlarged detail view of an end of the tapered wedge of the self-contained waler clamp assembly shown in FIG. 7.

Referring now to FIGS. 6–8, an alternative embodiment of the self-contained waler clamp assembly 10 has been illustrated. The waler clamp assembly 110 is generally identical to the waler clamp assembly 10, with the exception of the opening in the upper and lower legs 118 and 120 and the form of the tapered wedge 146 and the enlargement 150 on the narrow end thereof. As a result, the other aspects of the waler clamp assembly 110 will not be described in order to avoid unnecessary duplication.

As shown in FIG. 7, the waler clamp assembly 110 includes generally aligned openings in the form of a pair of wedge-receiving slots 130 and 132 extending in a direction generally parallel to the legs 118 and 120 of the bracket 116. As will also be appreciated, the tapered wedge 146 comprises a flat generally V-shaped wedge having a wooden waler-engaging surface 146*a* and a pair of flat generally parallel surfaces such as 146*b* so as to conform to the slots 130 and 132 for limited sliding movement relative to the legs 118 and 120. As will further be noted by referring to FIG. 8, the tapered wedge 146 is formed so as to have an enlargement 150 on the narrow end thereof in order to retain the integral relationship of the bracket 116 with the tapered wedge 146.

From the foregoing description of the preferred embodiments, it should now be appreciated that the present invention is directed to a unique new form of self-contained waler clamp assembly. This waler clamp assembly is well suited for any concrete form having a plurality of spaced form supports, but, in particular, it is especially well suited as a two-part assembly for an aluminum concrete wall form defined by a plurality of aluminum wall form panels, each having a vertical siderail for joining the aluminum wall form panels in upstanding edge-to-edge relationship for a concrete pour using the aluminum concrete wall form. As for the waler clamp assembly, it will now be understood to comprise only two components, and, even then, those two components are entirely integrally related.

With the water clamp assembly, a unique key and hole system greatly facilitates the assembly of concrete forms since it is simply necessary to insert the latching key into and through a pair of holes. The holes are typically aligned and in adjacent form supports or siderails and assembly is made with the bracket at a large acute angle to the concrete form, following which the bracket is securely locked within the holes in the adjacent form supports or siderails by pivoting the bracket to a position in which it is generally perpendicular to the concrete form. When in this position, the locking is completed by placing a waler board on the bracket and driving the tapered wedge to force the board against the form support or siderail of the concrete form.

When the concrete pour is completed, the disassembly of the waler clamp assembly is equally simple since it is only necessary to drive the tapered wedge in the opposite direction. This loosens the fit of the waler board relative to the form supports or siderails following which the waler board or boards can be removed from the bracket, the bracket can then be simply slipped out of the holes with the wedge still integrally associated with the bracket. Due to the simplicity of construction and utilization, the waler clamp assembly not only accommodates for ongoing variations in lumber sizes but also enhances concrete forming speed, productivity, and quality.

While in the foregoing there have been set forth preferred embodiments of the invention, it will be appreciated that the details herein given may be varied by those skilled in the art without departing from the true spirit and scope of the appended claims.

I claim:

1. In combination, a concrete form and a self-contained waler clamp assembly said combination comprising:

a concrete form having a pair of wall form panels, each of said wall form panels having a vertical siderail on confronting edges thereof, said vertical siderails having horizontally aligned round holes and a space therebetween;

a waler clamp assembly having a generally U-shaped bracket including a pair of generally parallel spaced legs joined at one end by a connecting bight portion, one of said legs having a distal end with a latching key extendable through said aligned holes in each of said vertical siderails in a first orientation of said bracket relative to said vertical siderails, said latching key comprising a flat finger generally coplanar with and extending generally perpendicular to said one of said legs, said latching key also having a tooth generally intermediate opposing ends of said flat finger and extending generally parallel to said one of said legs in a direction generally facing said bight portion of said bracket, said tooth being position in said space between said vertical siderails to cause said latching key to be securely latched within said vertical siderails in a second orientation of said bracket, said bracket also having generally aligned openings in said legs generally parallel to said bight portion at a point opposite said latching key; and said waler clamp assembly also having a tapered wedge projecting through said generally aligned openings in said bracket, said tapered wedge being movable generally perpendicular to said legs of said bracket to be driven so as to force a waler carried by said bracket against said vertical siderails, and including means for retaining said tapered wedge in integrally associated relation with said bracket.

2. The combination of claim 1 wherein at least one of said generally aligned openings in said legs is generally U-shaped having a waler-facing portion generally parallel to said bight portion of said bracket and a pair of leg-receiving portions generally perpendicular to said waler-facing portion of said generally U-shaped opening in a direction extending generally towards said bight portion of said bracket.

3. The combination of claim 2 wherein said tapered wedge is generally U-shaped having a flat waler-engaging surface disposed in said waler-facing portion of said generally U-shaped opening and having a pair of tapered legs integral with and generally perpendicular to said flat waler-engaging surface said tapered legs being disposed in said leg-receiving portions of said generally U-shaped opening for limited movement relative to said legs of said bracket.

4. The combination of claim 1 wherein said generally aligned openings include a pair of wedge-receiving slots extending in a direction generally parallel to said legs of said bracket, said tapered wedge comprising a flat generally V-shaped wedge having a waler engaging surface and a pair of flat generally parallel surfaces so as to conform to said slots for limited movement relative to said legs of said bracket.

5. In combination, a concrete wall form and a self-contained waler clamp assembly, said combination comprising:

a concrete wall form having a pair of wall form panels, each of said wall form panels having a vertical form support on confronting edges thereof, said vertical form supports having horizontally aligned round holes and a space therebetween;

a waler clamp assembly having a generally U-shaped bracket including a pair of generally parallel spaced legs joined at one end by a connecting bight portion, an tipper one of said legs having a distal end with a latching key extendable through said aligned holes in said adjacent vertical form supports in a first orientation of said bracket relative to said form supports, said latching key being securely latched within said holes in a second orientation when said bracket is generally perpendicular to said vertical form supports, said bracket also having generally aligned openings in said legs generally parallel to said bight portion opposite said latching key;

said latching key comprising a flat finger generally coplanar with and extending generally perpendicular to said upper one of said legs, said latching key also having a tooth generally intermediate opposing ends of said flat finger to be positioned in said space defined between said pair of adjacent vertical form supports to cause said latching key to be securely latched within said vertical form supports, said tooth extending generally parallel to said upper one of said legs in a direction generally facing said bight portion of said bracket; and said waler clamp assembly also having a tapered wedge projecting through said generally aligned openings in said bracket, said tapered wedge being movable generally perpendicular to said legs of said bracket to be driven so as to force a waler carded by said bracket against said concrete form, and an enlargement on a narrow end of said wedge for retaining said wedge integral with said bracket.

6. The combination of claim 5 wherein one of said generally aligned openings in said legs is generally U-shaped having a waler-facing portion generally parallel to said bight portion of said bracket and a pair of leg-receiving portions generally perpendicular to said waler-facing portion of said generally U-shaped opening in a direction extending generally towards said bight portion of said bracket.

7. The combination of claim 6 wherein the other of said generally aligned openings in said legs is generally rectangular having a waler-facing edge generally parallel to said bight portion of said bracket and a pair of leg-facing edges generally perpendicular to said waler-facing edge of said generally rectangular opening in a direction extending generally towards said bight portion of said bracket.

8. The combination of claim 6 wherein said tapered wedge is generally U-shaped having a flat waler-engaging surface disposed in said waler-facing portion of said generally U-shaped opening and having a pair of tapered legs integral with and generally perpendicular to said flat waler-engaging surface, said tapered legs being disposed in said leg-receiving portions of said generally U-shaped opening for limited movement relative to said legs of said bracket.

9. The combination of claim 5 wherein said generally aligned openings include a pair of wedge-receiving slots extending in a direction generally parallel to said legs of said bracket, said tapered wedge comprising a flat generally V-shaped wedge having a waler-engaging surface and a pair of flat generally parallel surfaces so as to conform to said slots for limited movement relative to said legs of said bracket.

10. The combination of claim 5 wherein said upper one of said legs is longer than a lower one of said legs with said latching key being positioned beyond a distal end of said lower one of said legs, said lower one of said legs having an internal bearing flange to engage said pair of vertical frame supports when said latching key is securely latched within said holes therein.

11. In combination, a self-contained two-part waler clamp assembly and an aluminum concrete wall said combination comprising:

an aluminum concrete wall defined by a plurality of aluminum wall form panels, each of said wall form panels having vertical siderails for joining said aluminum wall form panels in upstanding edge-to-edge relationship for a concrete pour using said aluminum concrete wall form, said vertical siderails having horizontally aligned round holes and a space therebetween;

a waler clamp assembly having a generally U-shaped bracket having a pair of generally parallel spaced legs joined at one end by a connecting bight portion, an upper one of said legs having a distal end with a latching key extendible through said aligned holes in an adjacent pair of said vertical siderails in a first orientation with said bracket at an acute angle to said concrete wall form, said latching key being securely latched within said aligned holes in said adjacent vertical siderails in a second generally horizontal orientation with said bracket generally perpendicular to said concrete wall form, said bracket also having generally aligned openings in said legs generally parallel to said bight portion opposite said latching key;

said latching key comprising a flat finger generally coplanar with and extending generally perpendicular to said upper one of said legs, said latching key also having a tooth generally intermediate opposing ends of said flat finger, said tooth extending generally parallel to said upper one of said legs in a direction generally facing said bight portion of said bracket;

said flat finger and tooth of said latching key being extendible through said hole in at least one of said adjacent vertical siderails to position said tooth within said space formed between said adjacent vertical siderails to allow said flat finger and tooth of said latching key to be securely latched in said vertical siderails in said generally horizontal orientation;

said upper one of said legs being formed so as to be longer than a lower one of said legs such that said latching key is positioned at a point beyond a distal end of said lower one of said legs, said lower one of said legs having an integral bearing flange engageable with said adjacent vertical siderails with said latching key securely latched within said vertical siderails in said generally horizontal orientation; and said waler claim assembly also having a tapered wedge projecting through said generally aligned openings in said bracket, said tapered wedge being movable generally perpendicular to said legs of said bracket to be driven so as to force a waler carried by said bracket against said vertical siderails, and an enlargement on a narrow end of said wedge for retaining said wedge integral with said bracket.

12. The combination of claim 11 wherein one of said generally aligned openings in said legs is generally U-shaped having a waler-facing portion generally parallel to said bight portion of said bracket and a pair of leg-receiving portions generally perpendicular to said waler-facing portion of said generally U-shaped opening in a direction extending generally towards said bight portion of said bracket.

13. The combination of claim 12 wherein the other of said generally aligned openings in said legs is generally rectangular having a waler-facing edge generally parallel to said bight portion of said bracket and a pair of leg-facing edges generally perpendicular to said waler-facing edge of said generally rectangular opening in a direction extending generally towards said bight portion of said bracket.

14. The combination of claim 12 wherein said tapered wedge is generally U-shaped having a flat aluminum-waler engaging surface slidably received in said waler-facing portion of said generally U-shaped opening and having a pair of tapered legs integral with and generally perpendicular to said flat aluminum waler-engaging surface, said tapered legs being slidably received in said leg-receiving portions of said generally U-shaped openings.

15. The combination of claim 11 wherein said generally aligned openings include a pair of wedge-receiving slots extending in a direction generally parallel to said legs of said bracket, said tapered wedge comprising a flat generally V-shaped wedge having a wooden waler-engaging surface and a pair of flat generally parallel surfaces so as to conform to said slots for limited sliding movement relative to said legs of said bracket.

* * * * *

UNITED STATES PATENT AND TRADEMARK OFFICE

CERTIFICATE OF CORRECTION

PATENT NO. : 5,562,845

DATED : October 8, 1996

INVENTORS : MILLER et al.

It is certified that error appears in the above-identified patent and that said Letters Patent is hereby corrected as shown below:

column 2, line 11, please replace "or" with --for--;

column 3, line 38, please replace "water" with --waler--;

column 7, line 48, please replace "tipper" with --upper--;

column 8, line 5, please replace "carded" with --carried--;

column 8, line 49, please between "wall" and "defined" please insert --form--; and column 9, line 26, please replace "claim" with --clamp--.

Signed and Sealed this

Nineteenth Day of August, 1997

*Attest:*

Bruce Lehman

BRUCE LEHMAN

*Attesting Officer*

*Commissioner of Patents and Trademarks*